US007442347B2

(12) United States Patent
Yoshimi et al.

(10) Patent No.: US 7,442,347 B2
(45) Date of Patent: Oct. 28, 2008

(54) HEAT INSULATING MEMBER FOR END CONE PORTION OF EXHAUST GAS CONVERSION APPARATUS

(75) Inventors: Mitsunori Yoshimi, Gifu (JP); Yasuhiro Tsuchimoto, Gifu (JP)

(73) Assignee: Ibiden Co., Ltd., Ogaki-shi (JP)

( * ) Notice: Subject to any disclaimer, the term of this patent is extended or adjusted under 35 U.S.C. 154(b) by 299 days.

(21) Appl. No.: 11/333,513

(22) Filed: Jan. 18, 2006

(65) Prior Publication Data

US 2006/0166584 A1 Jul. 27, 2006

(30) Foreign Application Priority Data

Jan. 25, 2005 (JP) ..... 2005-016907

(51) Int. Cl.
*B01D 50/00* (2006.01)

(52) U.S. Cl. ..... 422/179; 422/180; 422/221; 502/241; 501/95.1; 442/388

(58) Field of Classification Search ..... 422/179, 422/180, 221; 502/241, 242; 501/95.1; 442/388; 428/220, 219
See application file for complete search history.

(56) References Cited

U.S. PATENT DOCUMENTS 2,161,676 A * 6/1939 Houdry ..... 208/146
3,869,410 A * 3/1975 Bunda et al. ..... 502/262
4,127,556 A * 11/1978 Ushitani et al. ..... 252/62
4,144,195 A * 3/1979 Siebels ..... 502/241
4,847,140 A * 7/1989 Jaskowski ..... 428/220
4,863,700 A * 9/1989 Ten Eyck ..... 422/179
5,250,269 A 10/1993 Langer
5,380,580 A * 1/1995 Rogers et al. ..... 428/219
5,580,532 A 12/1996 Robinson et al.
5,996,228 A * 12/1999 Shoji et al. ..... 29/890
6,613,296 B1 9/2003 Myers et al.
7,261,864 B2 * 8/2007 Watanabe ..... 422/179

FOREIGN PATENT DOCUMENTS

| | | | |
|---|---|---|---|
| EP | 0 450 348 | A1 | 10/1991 |
| EP | 1 267 048 | A1 | 12/2002 |
| EP | 1 336 678 | A1 | 8/2003 |
| JP | 7-286514 | | 10/1995 |
| JP | 11-117731 | | 4/1999 |
| WO | WO 01/71170 | A1 | 9/2001 |
| WO | WO 03/000414 | A1 | 1/2003 |

* cited by examiner

*Primary Examiner*—N Edwards
(74) *Attorney, Agent, or Firm*—Oblon, Spivak, McClelland, Maier & Neustadt, P.C.

(57) ABSTRACT

A heat insulating member for an end cone portion of an exhaust gas conversion apparatus is formed by laminating sheets each made of alumina-silica based ceramic fibers to form a matte and subjecting the matte to needling in a lamination direction of the sheets, in which a composition of the ceramic fiber used in the matte is alumina:silica=60-80:40-20.

5 Claims, 1 Drawing Sheet

HEAT INSULATING MEMBER FOR END CONE PORTION OF EXHAUST GAS CONVERSION APPARATUS

TECHNICAL FIELD

This invention relates to a heat insulating member for an end cone portion of an exhaust gas conversion apparatus, and more particularly to a heat insulating member used in an end cone as a portion of introducing an exhaust gas from an exhaust pipe to a catalyst converter body of the exhaust gas conversion apparatus or discharging therefrom.

BACKGROUND ART

Heretofore, a heat insulating member 3 (FIG. 2) formed by laminating alumina-silica ceramic fiber sheets each having a composition ratio of alumina ($Al_2O_3$) to silica ($SiO_2$) of 50:50 has been used as a heat insulating member for a portion of an end cone e (FIG. 1) consisting of an outer cone 1 and an inner cone 2. There are heat insulating members as disclosed, for example, in JP-A-11-117731, U.S. Pat. No. 5,250,269 and the like.

Recently, the revolution number of the engine tends to increase with the high output of the engine, and also the displacement of the engine is made small accompanied with the fuel saving of the engine and hence it tends to raise the output by increasing the revolution number. Under such situations, the temperature of the exhaust gas rises in the driving of the engine, and as a result, the temperature of the exhaust gas becomes recently 900-1000° C. as compared with the conventional temperature of about 700-900° C. The contents of JP-A-11-117731, U.S. Pat. No. 5,250,269 are incorporated here in by reference in their entirety.

SUMMARY OF THE INVENTION

The inventors have found that a heat insulating member formed by laminating sheets each made of alumina-silica based ceramic fibers to form a matte and subjecting the matte to needling in a lamination direction of the sheets, in which a composition of the ceramic fiber used in the matte is alumina: silica=60-80:40-20, is effective as a heat insulating member for an end cone portion of an exhaust gas conversion apparatus.

In the invention, the composition ratio of alumina and silica is preferable to be 70-74:30-26. Also, it is preferable that an average fiber length of the ceramic fiber is not less than 50 μm but not more than 100 mm. Furthermore, a distance between adjoining needles applied to a surface of the matte in the needling is preferable to be about 1-100 mm. Moreover, an orienting angle (A) in the needling is preferable to be a gradient of not more than 60° with respect to a vertical direction of the matte surface.

BEST MODE FOR CARRYING OUT THE INVENTION

Figure 1:
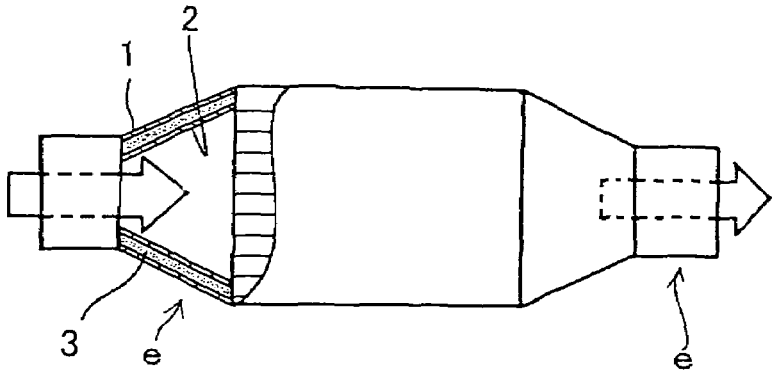
FIG. 1 is a section view showing an embodiment of the exhaust gas conversion apparatus.

Heat insulating members generally are high heat-conductive and have a problem that the heat resistance is poor at a high temperature of not lower than 850° C. Also, when such a heat insulating member is mounted onto the end cone portion, it has a problem in the durability against the exposure to high-temperature exhaust gas and the wind erosion. Further, it is difficult to shape the heat insulating member so as to well match with the structure of the end cone portion, and hence there is a problem in the handling such as assembling or the like.

Lately, therefore, the heat insulating member for the end cone portion is required to be designed so as to well durable against the temperature of the exhaust gas higher than the conventional one.

Further, the heat insulating member for the end cone portion is easily subjected to the wind erosion under such a higher temperature environment and the catalyst layer may be clogged by particles generated at such a state. Also, the heat insulating ability of the end cone portion is damaged by the wind erosion of the heat insulating member, and also the catalytic activity is lost and the exhaust pipe is damaged.

Further, the conventional alumina-silica based ceramic fibers are difficult to be assembled onto the exhaust pipe but also have a problem that the heat insulating member is peeled off in such an assembling.

It is, therefore, an object of the invention to provide a heat insulating member for an end cone portion having a heat insulating property higher than the conventional member and a high resistance to wind erosion due to heat and wind pressure of a high temperature exhaust gas.

It is another object of the invention to provide a heat insulating member for an end cone portion having an excellent workability in the assembling and a high peeling strength in the assembling.

According to the invention, there can be provided a heat insulating member for the end cone portion having a high heat resistance and a high resistance to wind erosion capable of being well durable to heat and wind pressure of a high temperature exhaust gas. Also, there can be provided a heat insulating member for an end cone portion having an excellent assembling workability and a high peeling strength in the assembling.

The invention is a heat insulating member for an end cone portion obtained by blowing alumina-silica based ceramic fibers through a sol-gel process to obtain a continuous sheet and folding and laminating it every a given length or piling plural cut sheets one upon the other to form a matte and then subjecting the matte to needling in a sheet lamination direction perpendicular to a surface of the matte. The feature thereof lies in that the composition of the matte inclusive of the needle is alumina:silica=approximately 60-approximately 80:approximately 40-approximately 20.

In the invention, the alumina-silica based ceramic fibers are desirable to utilize a precursor for alumina-silica based ceramic fiber (hereinafter referred to "aluminous fiber" simply) obtained by adding silica sol to an aqueous solution of a basic aluminum chloride having Al/Cl=approximately 1.8 (atomic ratio) (aluminum content=approximately 70 g/l) so as to render a composition ratio of alumina to silica into approximately 60-approximately 80:approximately 40-approximately 20. The reason why the composition of the precursor for the aluminous fiber is limited to the above is due to the fact that when the alumina content is less than approximately 60 mass % or the silica content is less than approximately 20 mass %, silica becomes rich and the heat resistance is lacking and the hot reaction force lowers, while when the alumina content exceeds approximately 80 mass % or the silica content exceeds approximately 40 mass %, alumina becomes rich and the brittleness becomes high to lower the toughness and the fiber strength against vibration of the vehicle or shock of the exhaust gas is not obtained. Moreover, the composition is preferable to be approximately 70-approximately 74:approximately 30-approximately 26.

The aluminous fiber is obtained by adding an organic polymer such as polyvinyl alcohol or the like to the precursor for the aluminous fiber and concentrating them to form a spinning solution and then spinning this spinning solution through a blowing process. That is, the aluminous fibers are produced by adjusting an aperture size in the blowing to provide an average fiber length of not less than approximately 50 μm but not more than approximately 100 mm. When the length of the aluminous fiber is more than approximately 50 μm, the fibers entangle with each other in the needling and the strength is sufficient and the wind erosion is not easily caused in the contacting with the exhaust gas. Further, when the length of the aluminous fiber is not more than approximately 100 mm, the fiber length is not too long and the restraining force through the matte thickness does not lower in the needling and the matte does not become too bulk and the assembling is not difficult. Moreover, the average fiber length is preferable to be not less than approximately 10 mm but not more than approximately 70 mm.

Then, the aforementioned aluminous fibers are fibrillated by blowing through a sol-gel process and laminated to produce laminate sheets of the aluminous fibers or a matte. The thus produced matte of the aluminous fibers is subjected to a needling treatment.

Moreover, the needling treatment means a treatment for folding or laminating the sheets of the aluminous fibers to suppress the bulk height and make thin and hard to thereby facilitate the handling but also enhancing the strengthening between the laminated sheets. According to this treatment, the aluminous fibers are introduced in a direction perpendicular to the matte surface of the aluminous fiber sheets (thickness direction of the sheet laminate) or a direction directing to the longitudinal direction, which results in the complexedly entangled orientation into three-dimensional direction and hence brings about the strengthening between the laminated sheets forming the matte of the aluminous fibers.

Figure 2:
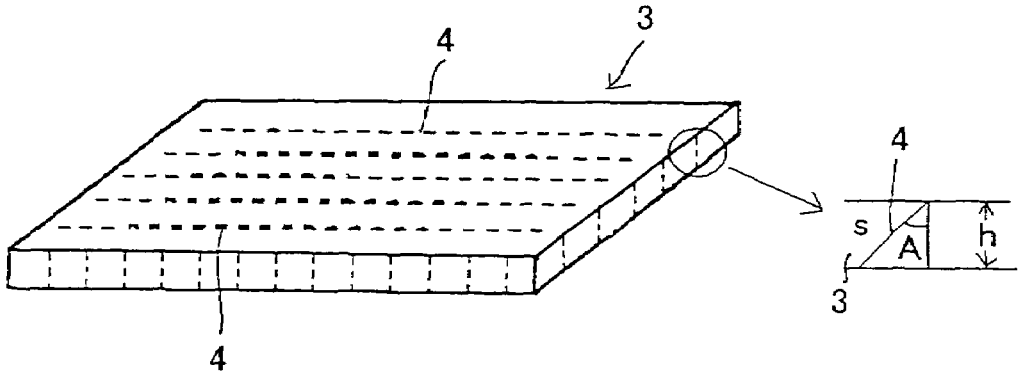
FIG. 2 is a perspective view of a matte schematically showing a detailed structure of the matte.

In such a needling treatment, the distance between the adjoining needles in a horizontal direction (XY direction) introduced in the thickness direction of the laminated sheets is approximately 1-100 mm, preferably approximately 2-10 mm. When the distance is more than 1 mm, the sufficient strengthening between the laminated sheets is obtained and there is not a fear of causing the peeling between the laminated sheets in the assembling onto the end cone portion of the exhaust pipe. Further, when the distance is not more than 100 mm, the sufficient elastic force is obtained by the orientation of the fibers introduced in the thickness direction through the needling and there is not a fear of detaching from the end cone portion of the exhaust pipe. As shown in FIG. 2, when the needling orientation length is s and the thickness of the matte is h and an angle defined by s and h is a needling orientation angle A, the needling is carried at an angle of A (h/s)=approximately 0.5-approximately 0.87.

Then, the matte (laminated sheets) of the aluminous fibers subjected to the needling treatment is raised from room temperature and continuously fired at a highest temperature of approximately 1250±50° C. to obtain a matter made of aluminous fiber laminated sheets having given thickness and composition.

The thus obtained aluminous fiber matte (continuous laminated sheets) is cut for facilitating the handling operation at subsequent step. In this case, it may be effective to control alumina spherical solid matter called as shots included in the aluminous fiber matte. The shots are produced in the course of blowing the spinning solution. When the amount of the shots is not less than approximately 7 mass %, the damage of the aluminous fibers may be caused in the mounting of the matte onto the end cone portion. Particularly, this phenomenon is conspicuous when the bulk density of the matte after the needling treatment (GBD) is approximately 0.2-approximately 0.55 g/cm$^3$. If the above damage is caused, the wind erosion is easily caused in case of contacting with the high temperature exhaust gas, and the clogging in the catalyst is caused by fiber dust generated.

Then, the cut matte (continuous laminated sheets) is subjected to an impregnation treatment with an organic binder. This treatment is carried out for assisting the easy operation in the assembling of the heat insulating member onto the end cone portion. As the organic binder can be used various rubbers, thermoplastic resins, thermosetting resins and the like. As the rubber may be used natural rubber; acrylic rubbers such as ethylacrylate-chloroethyl vinyl ether copolymer, n-butylacrylate-acrylonitrile copolymer, ethylacrylate-acrylonitrile copolymer and the like; nitrile rubber such as butadiene-acrylonitrile copolymer and the like; butadiene rubber and so on. As the thermoplastic resin may be used acrylic resins such as homopolymers or copolymers of acrylic acid, acrylic ester, acrylamide, acrylonitrile, methacrylic acid, methacrylic ester and the like; acrylonitrile-styrene copolymer; acrylonitrile-butadiene-styrene copolymer and so on. As the thermosetting resin may be used bisphenol type epoxy resin, novolac type epoxy resin and the like. Among the above organic binders, the acrylic resin such as acrylic or methacrylic polymer and the like are effective.

Concretely, the impregnation treatment is carried out by preparing an aqueous dispersion from the above acrylic resin and water and then impregnating the surface of the matte with the dispersion. In general, the matte of the aluminous fibers contains the resin (solid content) in an amount larger than the required amount together with water through the impregnation treatment, so that the excess solid content should be removed. The removal of the solid content can be carried out by suction at a suction force of about 1-50 kPa for 1 second or more.

In the laminated sheets of the aluminous fibers at this stage is still contained water in addition to the solid content, so that it is required to remove water. The removal of water can be carried out by heating, pressurizing and drying. In this step, if the matte of the aluminous fibers including the organic binder itself is compressed together with the removal of water, the assembling operation onto the end cone portion of the exhaust pipe is facilitated but also the organic binder is burnt out during the supply of the high temperature exhaust gas to expendably restore the compressed matte of the aluminous fibers, which is strongly kept between the outer cone and the inner cone.

The temperature of the compression drying is preferable to be about approximately 95-approximately 155° C. When the drying temperature is lower than approximately 95° C., the drying time becomes long and the production efficiency is poor, while when it exceeds approximately 155° C., the decomposition of the organic binder starts to damage the adhesion ability of the organic binder. The drying time is preferable to be not less than approximately 100 seconds. When the time is shorter than the above value, the drying is not sufficiently attained. Further, the pressurization in the drying is carried out by heating under a condition of approximately 5-approximately 30 MPa so as to render a thickness after the compression into approximately 4-approximately 15 mm. For example, when the compression thickness is less than 4 mm and the pressure is higher than approximately 30 MPa, the damage of the ceramic fibers such as aluminous fibers and the like is caused, while when the compression thickness is more than approximately 15 mm and the pressure is lower than approximately 5 MPa, the necessary compression effect is not obtained.

Thereafter, the heated, pressurized and dried matte of the ceramic fibers such as aluminous fibers and the like (laminated sheets) is cut into a heat insulating member for the end cone portion.

EXAMPLES

Example 1

(Production of Matte: Laminated Sheets)

To an aqueous solution of basic aluminum chloride having an aluminum content of 70 g/l and Al/Cl=1.8 (atomic ratio) is added silica sol so that a composition of aluminous fibers is $Al_2O_3$:$SiO_2$=72±2:28±2 to obtain a precursor of aluminous fibers as a ceramic fiber. Then, an organic polymer such as polyvinyl alcohol or the like is added to the precursor of aluminous fibers to prepare a concentrated spinning solution. A continuous sheet is prepared by adjusting a size of a blowing orifice so as to provide an average fiber length of 60 mm when this spinning solution is spun through a blowing process, and laminated one upon the other to produce continuous laminated sheets of aluminous fibers.

The thus produced continuous laminated sheets of aluminous fibers are subjected to a needling treatment at a distance between mutual needles of 2 mm and a needling orientation angle of A=0.7. Then, the continuous laminated sheets are heated from room temperature and continuously fired at a maximum temperature of 1250±50° C. to obtain an aluminous fiber lamination sheet of 1050 g/cm$^2$.

(Cutting of Lamination Sheet)

The continuous lamination sheet of aluminous fibers is cut into a matte having a width of 500-1400 mm, a length of 50000-55000 mm and a thickness of 10 mm. As to shots included in the matte, it is confirmed that not more than 7 mass % of the shots of not less than 45 μm is included in the matte as measured by a sieve and a weighing meter.

(Resin Impregnation)

The matte of the aluminous fiber continuous laminated sheets obtained in the above step is subjected to an impregnation with an organic resin by providing an aqueous dispersion of an acrylic resin (solid content: 50±10 mass %, pH: 5.5-7.0) so as to adjust a resin concentration to 0.5-30 mass % and impregnating the aqueous dispersion of the acrylic resin into the surface of the matte cut at 1280 mm on a conveyor. At this stage, a greater amount of the solid content is adhered to the matte of the aluminous fiber laminated sheets.

(Suction of Solid Content)

After the impregnation treatment with the resin, the excess solid content adhered to the matte is removed by suction. In this case, the solid content is removed by suctioning the matte at a suction force of 5-50 kPa for not less than 1 second. After this treatment, the impregnation ratio of the resin is 55 mass % per the weight of the matte as measured by a weighing meter.

(Drying)

The matte of the aluminous fibers after the suction is dried by heating under pressure at a drying temperature of 95-155° C. and a compression width in the drying of 4-15 mm for a drying time of not less than 100 seconds. The thus obtained matte of the aluminous fibers have a resin adhesion ratio of 10 mass % per the weight of the matte as measured by the weighing meter and a thickness of 3-15 mm. Moreover, the matte is punched, if necessary.

Example 2

(Production of Matte: Lamination Sheet)

To an aqueous solution of basic aluminum chloride having an aluminum content of 70 g/l and Al/Cl=1.8 (atomic ratio) is added silica sol so that a composition of aluminous fibers is $Al_2O_3$:$SiO_2$=72±2:28±2 to obtain a precursor of aluminous fibers as a ceramic fiber. Then, an organic polymer such as polyvinyl alcohol or the like is added to the precursor of aluminous fibers to prepare a concentrated spinning solution. A continuous sheet is prepared by adjusting a size of a blowing orifice so as to provide an average fiber length of 12 mm when this spinning solution is spun through a blowing process, and laminated one upon the other to produce continuous laminated sheets of aluminous fibers.

The thus produced continuous laminated sheets of aluminous fibers are subjected to a needling treatment at a distance between mutual needles of 2 mm and a needling orientation angle of A=0.7. Then, the continuous laminated sheets are heated from room temperature and continuously fired at a maximum temperature of 1250±50° C. to obtain an aluminous fiber lamination sheet of 1050 g/cm$^2$.

(Cutting of Lamination Sheet)

The continuous lamination sheet of aluminous fibers is cut into a matte having a width of 500-1400 mm, a length of 51000-52500 mm and a thickness of 10 mm. As to shots included in the matte, it is confirmed that not more than 7 mass % of the shots of not less than 45 μm is included in the matte as measured by a sieve and a weighing meter.

(Resin Impregnation)

The matte of the aluminous fiber continuous laminated sheets obtained in the above step is subjected to an impregnation with an organic resin by providing an aqueous dispersion of an acrylic resin (solid content: 50±10 mass %, pH: 5.5-7.0) so as to adjust a resin concentration to 0.5-30 mass % and impregnating the aqueous dispersion of the acrylic resin into the surface of the matte cut at 500-1400 mm on a conveyor. At this stage, a greater amount of the solid content is adhered to the matte of the aluminous fiber laminated sheets.

(Suction of Solid Content)

After the impregnation treatment with the resin, the excess solid content adhered to the matte is removed by suction. In this case, the solid content is removed by suctioning the matte at a suction force of 5-50 kPa for not less than 1 second. After this treatment, the impregnation ratio of the resin is 55 mass % per the weight of the matte as measured by a weighing meter.

(Drying)

The matte of the aluminous fibers after the suction is dried by heating under pressure at a drying temperature of 95-155° C. and a compression width in the drying of 4-15 mm for a drying time of not less than 100 seconds. The thus obtained matte of the aluminous fibers have a resin adhesion ratio of 10 mass % per the weight of the matte as measured by the weighing meter and a thickness of 3-15 mm. Moreover, the matte is punched, if necessary.

Reference Example 1

A matte of aluminous fibers is prepared in the same manner as in Example 1 except that silica sol is added to the aqueous solution of the basic aluminum chloride having an aluminum content of 70 g/l and Al/Cl=1.8 (atomic ratio) so as to render a composition of aluminous fibers into $Al_2O_3$:$SiO_2$=80±2:20±2.

Reference Example 2

A matte of aluminous fibers is prepared in the same manner as in Example 1 except that silica sol is added to the aqueous solution of the basic aluminum chloride having an aluminum content of 70 g/l and Al/Cl=1.8 (atomic ratio) so as to render a composition of aluminous fibers into $Al_2O_3$:$SiO_2$=60±2:40±2.

Reference Example 3

A matte of aluminous fibers is prepared in the same manner as in Example 1 except that the aluminous fibers are cut into an average fiber length of 0.25 mm after the completion of the spinning through a blowing process.

Reference Example 4

A matte of aluminous fibers is prepared in the same manner as in Example 1 except that the needling is carried out at an angle corresponding to a needling orientation angle of A=0.42.

Reference Example 5

A matte of aluminous fibers is prepared in the same manner as in Example 1 except that the distance between needles is 10 mm.

Comparative Example 1

A starting material having a composition of $Al_2O_3$:$SiO_2$=50±2:50±2 is electrically melted, which is blown through a high pressure air stream to form fibers, which is mixed with 8 parts by mass of an organic binder (acryl emulsion) based on 100 parts by mass of the resulting aluminous fibers having an average fiber length of 2 mm to prepare an aqueous slurry for a matte layer. Then, the aqueous slurry for the matte layer is adhered to a surface of a flat stainless net of 200 mesh and dehydrated by suction to obtain a wet shaped body having a thickness of 8 mm. The wet shaped body is pressed to obtain a wet shaped body having a thickness of 5 mm. Thereafter, the wet shaped body is dried at 100-140° C. for 1 hour to obtain a ceramic fiber heat insulating member having a composition of $Al_2O_3$:$SiO_2$=50±2:50±2.

Comparative Example 2

A matte of aluminous fibers is prepared in the same manner as in Example 1 except that silica sol is added to the aqueous solution of the basic aluminum chloride having an aluminum content of 70 g/l and Al/Cl=1.8 (atomic ratio) so as to render a composition of aluminous fibers into $Al_2O_3$:$SiO_2$=85±2:15±2.

Comparative Example 3

A matte of aluminous fibers is prepared in the same manner as in Example 1 except that silica sol is added to the aqueous solution of the basic aluminum chloride having an aluminum content of 70 g/l and Al/Cl 1.8 (atomic ratio) so as to render a composition of aluminous fibers into $Al_2O_3$:$SiO_2$=55±2:45±2.

Comparative Example 4

A matte of aluminous fibers is prepared in the same manner as in Example 1 except that the aluminous fibers are cut into an average fiber length of 0.2 mm after the completion of the spinning through a blowing process.

Comparative Example 5

A matte of aluminous fibers is prepared in the same manner as in Example 1 except that the needling is carried out at an angle corresponding to a needling orientation angle of A=65°.

Comparative Example 6

A matte of aluminous fibers is prepared in the same manner as in Example 1 except that the distance between needles is 12 mm.

TABLE 1

| | | Composition of inorganic fibers | | Average fiber | Needling orientation | Distance between mutual | Thermal conductivity 800° C. | Wind erosion property 800° C. | Tensile | |
|---|---|---|---|---|---|---|---|---|---|---|
| | | $Al_2O_3$ (mass %) | Si (mass %) | length (mm) | angle (°) | needles (mm) | GBD = 0.3 g/cm$^3$ (W/m*K) | GBD = 0.3 g/cm$^3$ (mm) | strength (Kpa) | Judgement |
| Example | 1 | 72 | 28 | 60 | 0.7 | 2 | 0.13 | 0.8 | 207.9 | ◎ |
| | 2 | 72 | 28 | 12 | 0.7 | 2 | 0.13 | 1 | 205.2 | ○ |
| Reference example | 1 | 80 | 20 | 60 | 0.7 | 2 | 0.12 | 0.8 | 163.4 | Δ |
| | 2 | 60 | 40 | 60 | 0.7 | 2 | 0.16 | 0.9 | 189.7 | Δ |
| | 3 | 72 | 28 | 0.25 | 0.7 | 2 | 0.13 | 1.4 | 199.4 | ▲ |
| | 4 | 72 | 28 | 60 | 0.42 | 2 | 0.13 | 1.3 | 212.2 | ▲ |
| | 5 | 72 | 28 | 60 | 0.7 | 10 | 0.13 | 0.8 | 158.2 | ▲ |
| Comparative example | 1 | 50 | 50 | 2 | — | — | 0.23 | 14.5 | 10.5 | X |
| | 2 | 85 | 15 | 60 | 0.7 | 2 | 0.11 | 1 | 125.6 | X |
| | 3 | 55 | 45 | 60 | 0.7 | 2 | 0.2 | 0.8 | 207.9 | X |
| | 4 | 72 | 28 | 0.2 | 0.7 | 2 | 0.13 | 2.2 | 185.6 | X |
| | 5 | 72 | 28 | 60 | 0.42 | 2 | 0.13 | 1.8 | 172.2 | X |
| | 6 | 72 | 28 | 60 | 0.7 | 12 | 0.13 | 0.8 | 120.2 | X |

Moreover, the tests for the properties of the mattes in the above examples, reference examples and comparative examples are carried out under the following conditions.

(Measurement of Average Fiber Length)

Fibers are taken out from a sample through pincette and placed on a slide glass and observed by means of a polarizing microscope having objective lens of 40×10 to measure optional 100 fiber lengths with a scale.

As seen from the test results, the average fiber length of the aluminous fibers is important to be not less than 50 μm. Also, it is seen that the upper limit of the average fiber length is 100 mm.

(Thermal Conductivity)

Cut samples of 100×100 mm are piled one upon the other so as to have a constant bulk density of 0.3 g/cm$^3$ and compressed to adjust the weight. Then, a heating wire and thermocouple are interposed in the vicinity of the center of the sample and sandwiched between compression plates so as to adjust a thickness to 100 mm. Thereafter, they are placed in an electric furnace to conduct the measurement after the temperature (600-1000° C.) becomes stable. The measurement is repeated at the same temperature 3 times or more at an interval of not less than 10 minutes and an average value thereof is calculated as a thermal conductivity to form a graph between temperature and thermal conductivity.

As seen from the test results, the thermal conductivity is required to be not more than 0.2 W/m*K at a bulk density (GBD) of 0.2-0.4 g/cm$^3$. Also, it is required that the thermal conductivity at a temperature of 600-800° C. is not more than 0.15 W/m*K and the thermal conductivity at a temperature of 800-1000° C. is 0.18 W/m*K.

(Wind Erosion Property)

Cut samples of 40×25 mm are laminated so as to provide a constant bulk density of 0.3 g/cm$^3$ and compressed using SUS jig with a spacer and set in a furnace for wind erosion test heated to 800° C. and then left to stand for 1 hour. Then, air is exposed through an air nozzle at a pressure of 1.5 kg/cm for 3 hours and a wind eroded distance after the test is measured. The wind eroded distance per 3 hours is calculated to form a graph between GBD and wind eroded distance. In case of passing through the sample within 3 hours, the rapid temperature changing point is a through point, from which is calculated the test time.

As seen from the test results, the wind eroded distance is required to be not more than 8 mm at the bulk density (GBD) of 0.3 g/cm$^3$. Also, the wind eroded distance is desirable to be not more than 4 mm at the bulk density (GB) of 0.3 g/cm$^3$.

(Tensile Strength)

A cut sample of 200×50 mm is fixed at upper and lower margins of 50×30 mm and tensioned at a rate of 10 mm/min upward to measure a maximum value of a load at tension. Then, a tensile strength per unit area is calculated by the following equation using a sectional area calculated from the sample thickness×sample width of 50 mm:

$$\text{Tensile strength [kPa]} = \text{Load [N]} / \text{Sectional area [mm}^2\text{]}$$
$$(\text{sample thickness [mm]} \times \text{sample width [mm]}/10)$$

INDUSTRIAL APPLICABILITY

The invention is a heat insulating member used in an end cone portion of an exhaust gas conversion apparatus for an internal engine such as diesel engine or the like, or an apparatus connected to an exhaust pipe for a turbine engine or the like. Further, the invention can be used as a heat insulating member for the exhaust pipe other than the end cone portion or as a sound absorption or sound proof member for the exhaust pipe.

What is claimed is:

1. A heat insulating member for an end cone portion of an exhaust gas conversion apparatus, comprising:

a mat including laminated sheets each made of alumina-silica based ceramic fibers and having needled interconnections extending in a lamination direction and in a longitudinal direction of the sheets to laminate the sheets together;

a composition of the ceramic fiber used in the mat is alumina:silica=60-80:40-20; and one of said needled interconnections forming an orientation angle A (h/s) ranging from 0.5 to 0.87, where h is a thickness of the mat and s is a length of the one of the needled interconnections extending across the mat, wherein, along a direction of the orientation angle A, the alumina-silica based ceramic fibers are entangled between the laminated sheets.

2. A heat insulating member according to claim 1, wherein the composition of alumina to silica is 70-74:30-26.

3. A heat insulating member according to claim 1, wherein the ceramic fiber has an average fiber length of not less than 50 μm but not more than 100 mm.

4. A heat insulating member according to claim 1, wherein the needled interconnections are separated at a distance between mutual needle interconnections of 1-100 mm.

5. A heat insulating member according to claim 1, wherein needled interconnections are set at said orientation angle of not more than 60° with respect to a direction perpendicular to the surface of the mat.

* * * * *